United States Patent [19]

Perry et al.

[11] 4,368,845

[45] Jan. 18, 1983

[54] RAILROAD CROSSING STRUCTURE

[75] Inventors: John A. Perry, McHenry; Frank M. Perry, Wonder Lake; Gerald P. Konczyk, Schaumburg, all of Ill.

[73] Assignee: Park Rubber Company, Lake Zurich, Ill.

[21] Appl. No.: 239,325

[22] Filed: Mar. 2, 1981

[51] Int. Cl.[3] ..... E01C 9/004

[52] U.S. Cl. ..... 238/8; 404/43

[58] Field of Search ..... 238/2, 8, 9, 10 R, 10 C, 238/12; 404/31-41, 43-46, 67, 71

[56] References Cited

U.S. PATENT DOCUMENTS

| | | | |
|---|---|---|---|
| 1,598,584 | 8/1926 | Jones | 238/8 |
| 2,089,025 | 8/1937 | Hedgcock | 238/8 |
| 2,473,941 | 6/1949 | Condon | 238/8 |
| 2,828,079 | 3/1958 | Rennels | 238/8 |
| 2,828,080 | 3/1958 | Rennels | 238/8 |
| 2,833,480 | 5/1958 | Sandberg | 238/8 |
| 3,465,963 | 9/1969 | Caillet et al. | 238/8 |
| 3,843,051 | 10/1974 | Whitlock | 238/8 |
| 3,866,830 | 2/1975 | Hein et al. | 238/8 |
| 4,093,120 | 6/1978 | Canfield | 238/8 |
| 4,117,977 | 10/1978 | Whitlock | 238/8 |

FOREIGN PATENT DOCUMENTS

| | | | |
|---|---|---|---|
| 610112 | 5/1926 | France | 238/8 |

*Primary Examiner*—Joseph F. Peters, Jr.
*Assistant Examiner*—M. J. Hill
*Attorney, Agent, or Firm*—Robert E. Knechtel; Basil E. Demeur

[57] ABSTRACT

A railroad crossing structure for providing an improved devil strip. In particular, the invention proposes to bridge the span between adjacent sets of tracks with bridge members of steel or other like material of sufficient strength and rigidity. These bridge members preferably correspond in number to the ties supporting the rails in the area of the crossing, and are secured to them in any suitable fashion. The bridge members may be leveled to provide a flat horizontal surface by notching the ties to receive the ends of the bridge members. The space between the ends of the bridge members and the rails are filled with shims. Thereafter, an elastomeric surface is provided atop the bridge members, using elastomeric pads preferably of the type disclosed in the above-mentioned U.S. Pat. No. 4,093,120. Elastomeric pads of the type disclosed in this patent are preferred since the pads can be easily affixed atop the bridge members because no spikes are required. When the area between the rails is provided with similar elastomeric pads as disclosed in this patent, the resulting railroad crossing structure is entirely covered with an elastomeric surface.

8 Claims, 5 Drawing Figures

RAILROAD CROSSING STRUCTURE

BACKGROUND OF THE INVENTION

This invention relates to an improved railroad crossing structure. More particularly, it relates to an improved arrangement and method for completing a railroad crossing in that area of the crossing commonly referred to as the devil strip, i.e., that area between adjacent sets of tracks.

In recent years, considerable efforts have been made to provide an improved railroad crossing structure, one which is both safe for rail and vehicle traffic and which eliminates the foremost causes of grade crossing problems. One of the principle improvements in railroad crossing structures has been the provision of elastomeric pads which are disposed between the rails and at each side or field area thereof. In U.S. Pat. No. 4,093,129, one such railroad crossing structure comprised of elastomeric pads is disclosed which provides a watertight surface to protect the sub-structure against deterioration due to water, and which is installed without the need of spikes being driven through the pads and into the ties or shims. The disclosed railroad crossing structure has been highly successful because of these features, and particularly because no spikes are necessary.

One area of many railroad crossings which has not been improved is that area between adjacent sets of tracks of a crossing and commonly referred to as the devil strip. In most cases, the railroad crossing structure is improved by the use of the elastomeric pads as disclosed in the above-mentioned patent, but the devil strip or strips between the adjacent sets of tracks is simply paved with asphalt or other like material. These devil strips therefore normally deteriorate in a relatively short period of time as compared to the elastomeric crossing surface, and must be repaired or replaced periodically.

The industry has been seeking an arrangement and method to overcome the problems associated with the devil strips, but to date, no satisfactory solution has been provided.

SUMMARY OF THE INVENTION

The railroad crossing structure of the present invention comprises a solution to the problem of providing an improved devil strip. In particular, the invention proposes to bridge the span between adjacent sets of tracks with bridge members of steel or other like material of sufficient strength and rigidity. These bridge members preferably correspond in number to the ties supporting the rails in the area of the crossing, and are secured to them in any suitable fashion. The bridge members may be leveled to provide a flat horizontal surface by notching the ties to receive the ends of the bridge members. The space between the ends of the bridge members and the rails are filled with shims. Thereafter, an elastomeric surface is provided atop the bridge members, using elastomeric pads preferably of the type disclosed in the above-mentioned U.S. Pat. No. 4,093,120. Elastomeric pads of the type disclosed in this patent are preferred since the pads can be easily affixed atop the bridge members because no spikes are required. When the area between the rails is provided with similar elastomeric pads as disclosed in this patent, the resulting railroad crossing structure is entirely covered with an elastomeric surface.

Accordingly, it is an object of the present invention to provide an improved railroad crossing structure.

More particularly, it is an object to provide an improved railroad crossing structure in that area of the crossing commonly called the devil strip.

DETAILED DESCRIPTION OF THE INVENTION

Figure 1:
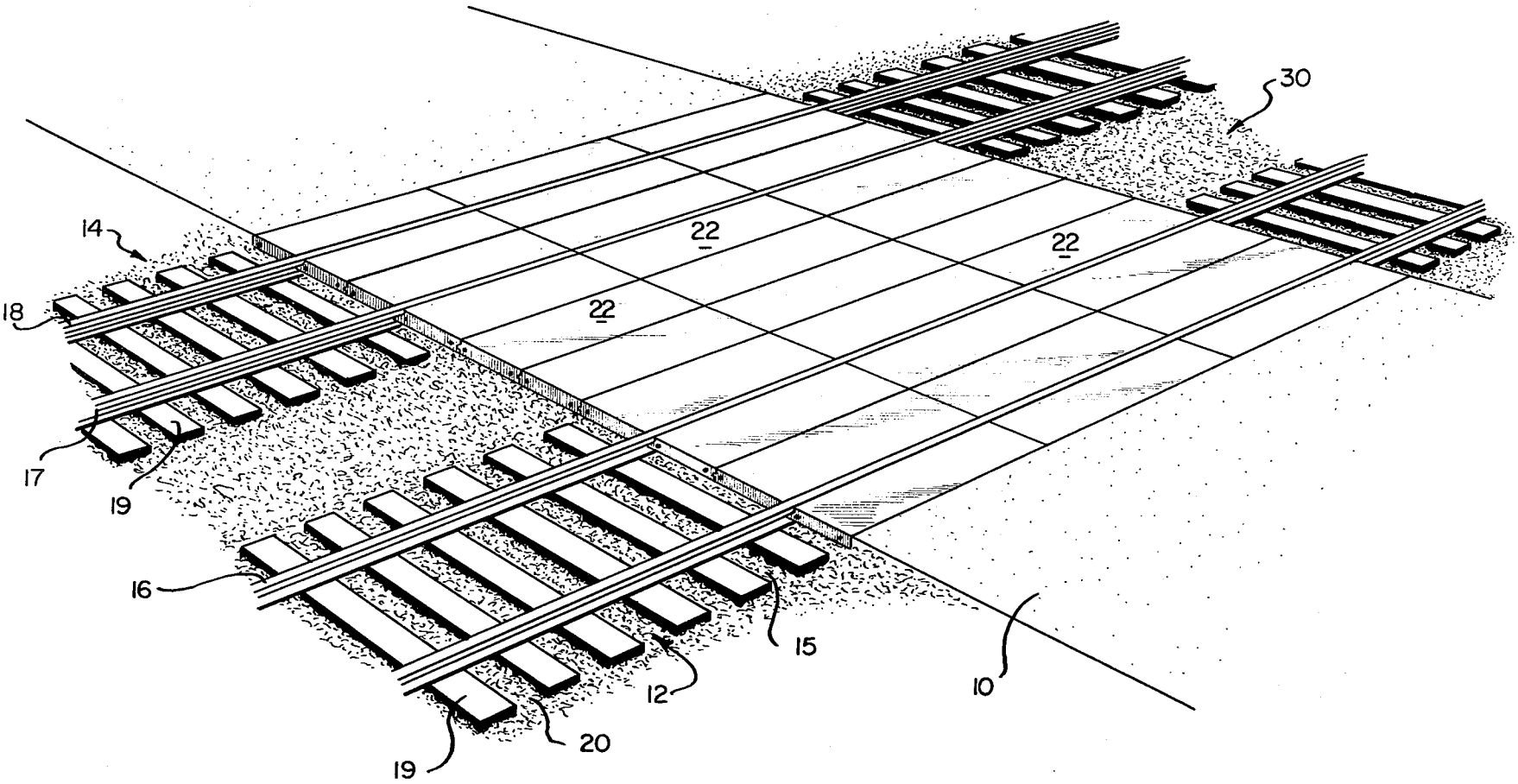
FIG. 1 is a perspective view generally illustrating a railroad crossing structure exemplary of the present invention.

Referring now to the drawings, in FIG. 1 there is illustrated a roadway 10 which is intersected by two railroad tracks 12 and 14. Each railroad track is of a generally standard construction, with the rails 15, 16 and 17, 18 thereof being supported upon and secured to a number of ties 19 which are, in turn, supported by means of ballast or sub-structure 20. In accordance with the invention, the entire crossing structure is covered or provided with an elastomeric surface comprised of a number of elastomeric pads 22, in the manner fully described below.

More particularly, the elastomeric pads 22 preferably and advantageously are of the type disclosed in U.S. Pat. No. 4,093,120, and the description of the structure and the manner of installation thereof between the rails and the side or field areas thereof as described therein is incorporated herein and made of a part hereof. Generally, each of the elastomeric pads 22 is molded of rubber or other similar material and are of a generally rectangular shape. The pads 22 between the rails are formed in complimentary pairs which are generally alike, however, the adjoining or abutting edges of the two pads having interlocking means which may be, for example, a complimentary tongue and groove arrangement. The opposite longitudinal edges of these pads are formed with a generally U-shaped channel which provides a flange area of receiving therein the flange portion of the wheels of a railroad car, as well as a drainage area for draining moisture such as rain, snow and the like from the railroad crossing. The opposite ends of the pads 22 also are formed with interlocking means which permit the pads to be joined together end-to-end to provide a tight seal between the adjoining edges. A flexible plate 34 (FIG. 4) which preferably and advantageously is a spring-steel plate with a slight concave cross-section is imbedded within each of the pads. Securement means 26 and 28 in the form of hollow tubes extend along each of the opposite longitudinal edges of the flexible plate 24, for receiving therethrough steel rods or cables 29 for securing the pads in place, in the manner described in U.S. Pat. No. 4,093,120. The elastomeric pads 22 along the side or field edges of the rails are of a similar construction and are installed in a like fashion. Reference may be made to U.S. Pat. No. 4,093,120 for a more detailed description of the elastomeric pads and the method in which they are installed.

As indicated above, the area between the sets of tracks 12 and 14 commonly is called the devil strip, indicated by the reference numeral 30. This devil strip 30, in the past, normally has been simply paved with asphalt or other similar material, thus only the immediate area between and beside the tracks are provided with an elastomeric surface.

In accordance with the present invention, bridge members 40, which span the distance between the ties 19 of the adjacent set of tracks 12 and 14, are provided and support other elastomeric pads 22 as more fully described below. The bridge members 40 may be steel beams of illustrated in FIG. 4, or wooden shims as illustrated in FIG. 5. The elastomeric pads 22 are substantially of the same construction as the pads disclosed in U.S. Pat. No. 4,093,120.

Figure 2:
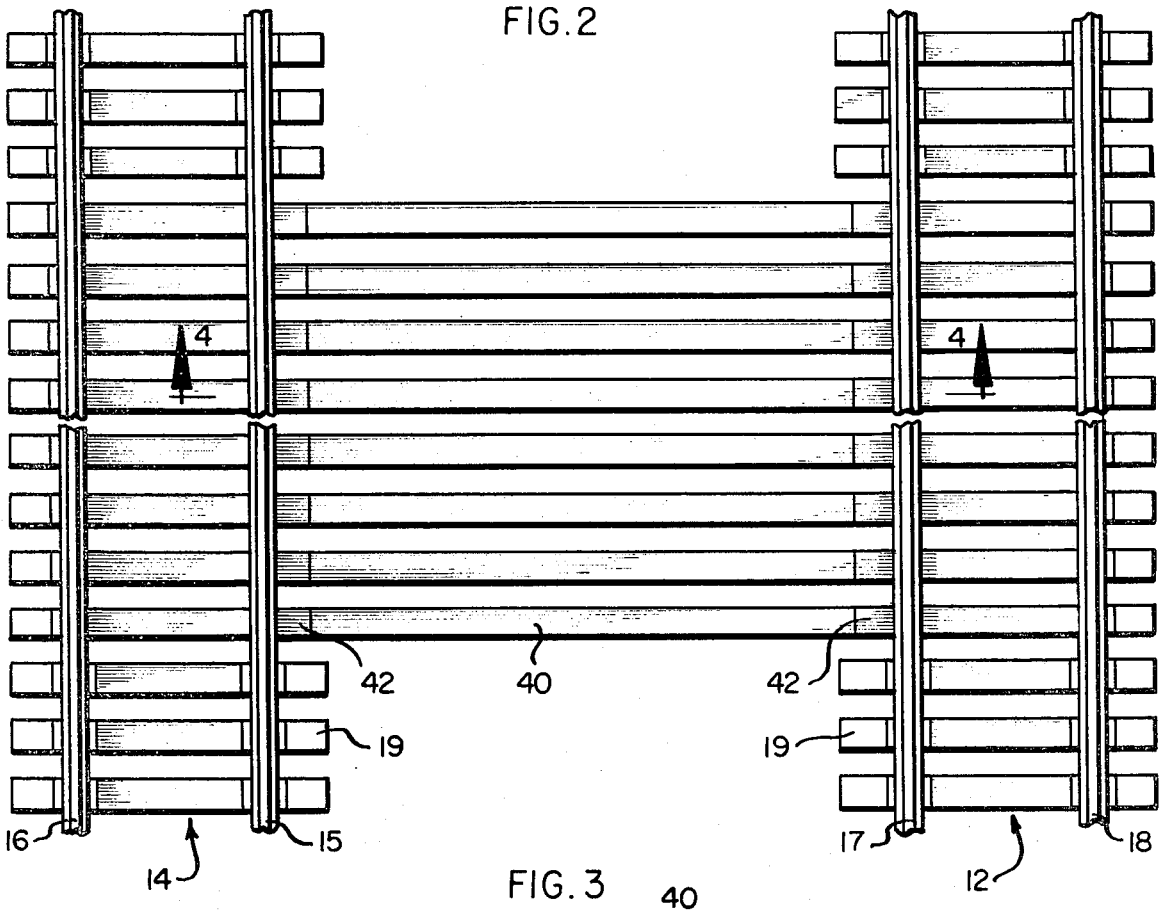
FIG. 2 is a top plan view illustrating the use of steel bridge members and shims to span the devil strip.
Figure 4:
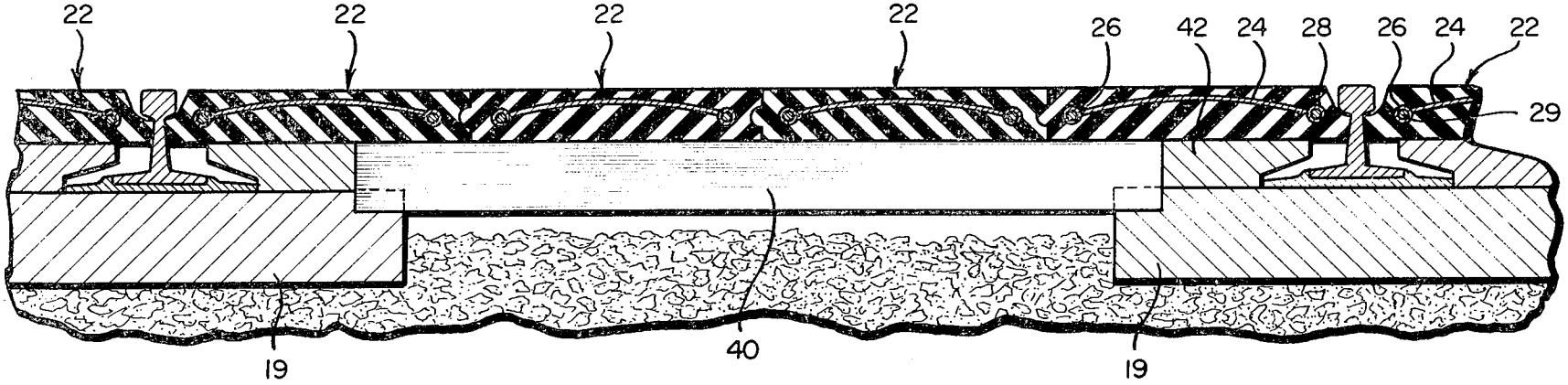
FIG. 4 is a sectional view taken generally along lines 4—4 of FIG. 2, with the addition of the elastomeric pads.
Figure 5:
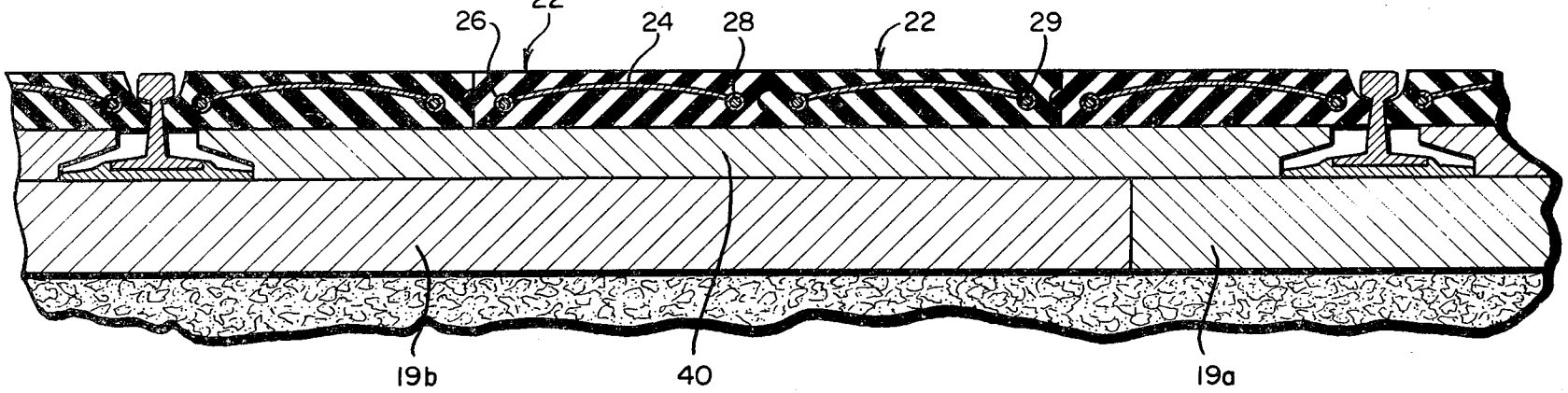
FIG. 5 is a sectional view taken generally along lines 5—5 of FIG. 3, with the addition of the elastomeric pads.

More particularly, as can be best seen in FIGS. 2 and 4, the ends of the steel bridge members 40 are supported by the ties 19 underlying the rails. In order to provide a level surface, the ties 19 may be notched to compensate for height variations and to establish the surface of the pads at the same or substantially the same height as the rail heads and the pads between the rails. A wooden shim 42 of a compensating height or thickness is disposed between the ends of the steel bridge members 40 and the rails. Preferably, a steel bridge member 40 and associated shims 42 are affixed to each tie 19 across the width of the crossing which is to be provided with the elastomeric surface, as illustrated in FIG. 2. The steel bridge members 40 and the shims 42 are secured to the ties 19 in any appropriate fashion, as for example, with spikes.

After the steel bridge members 40 and wooden shims 42 are secured to the ties 19, the elastomeric pads 22 are disposed atop of them to span the distance across the devil strip 30 between the adjacent rails. The longitudinal edges of elastomeric pads 22 have interlocking means which may be complimentary tongue and groove arrangements that permit the adjoining edges of the pads to be joined together to form a tight seal. Likewise, the ends of the pads have similar interlocking means so that the pads can be joined together end-to-end and sealed. The longitudinal edges of the pads adjacent to the rails are formed to abut the web portion of the rail to provide a tight seal with the rail. The pads also have embedded within them flexible steel plates 24 having hollow tubes extending along the longitudinal length thereof on each of the opposite edges for receiving steel rods or cables to secure the pads in place. In this respect, the devil strip is provided with an elastomeric surface comprised of elastomeric pads which are of substantially the same construction and are installed and retained in place in the same fashion, as those disclosed in U.S. Pat. No.4,093,120. The pads differ only in that fact that the longitudinal edges are formed with appropriate complimentary interlocking means to permit them to be joined in a sealing fashion across the width of the devil strip, or are formed to abut the rails to provide a tight seal with the rails. The rods or cables extended through the hollow tubes 26 are anchored and secured as described in U.S. Pat. No. 4,093,120.

Figure 3:
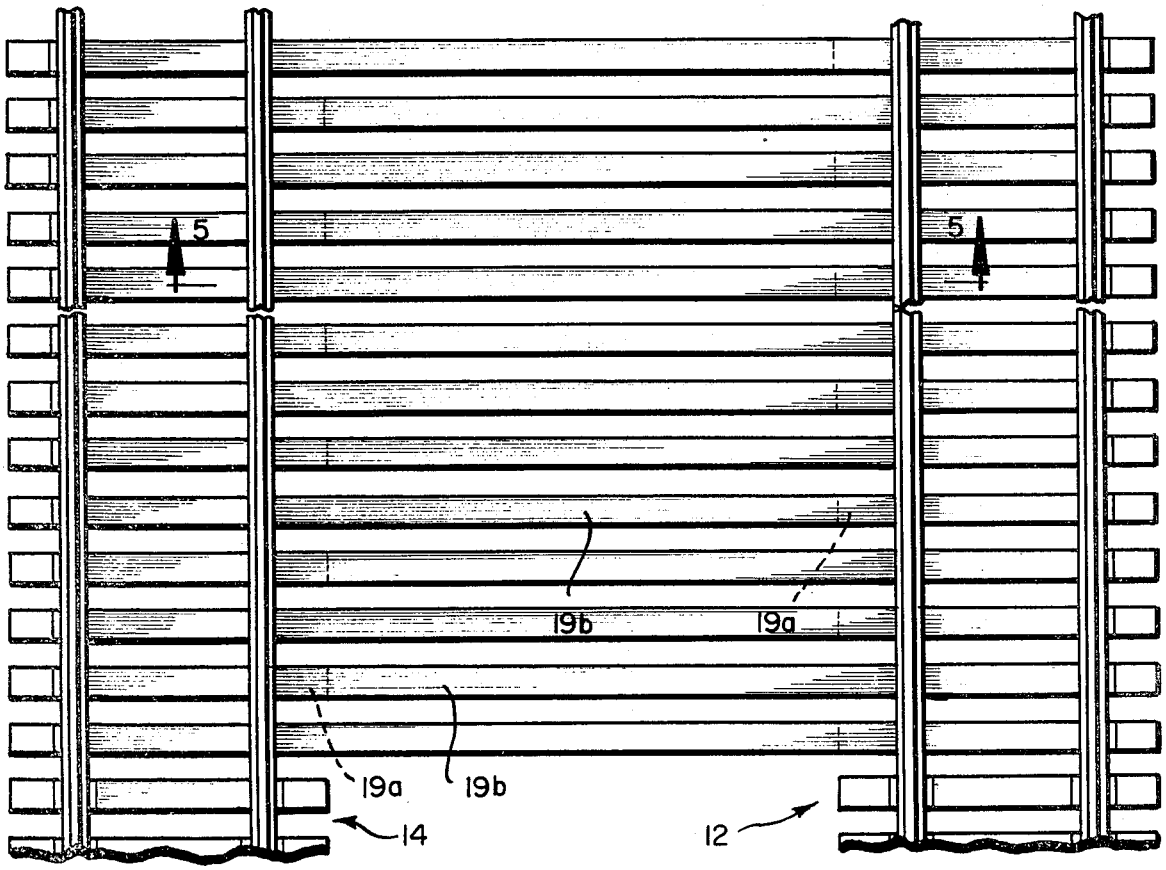
FIG. 3 is a top plan view illustrating the use of a wooden shim to span the devil strip.

In FIGS. 3 and 5, the devil strip 30 is provided with a similar elastomeric surface comprised of elastomeric pads, but in this case, the pads are supported upon wooden shim-type bridge members 40. The bridge members 40, in this instance, are of a thickness to compensate for the difference in the thickness of the pads and the rail height, and span the distance across the devil strip substantially rail-to-rail. The bridge members 40 may be secured to the ties 19 by means of spikes or other suitable securement means.

It is also advantageous and desirable to utilize alternating long and short ties in constructing the crossing structure. In doing so, the crossing structure is effectively tied together, forming a unitary crossing structure. More particularly, if it were possible or practical to obtain ties sufficiently long to span the distance across the entire crossing structure, i.e., sufficiently long to extend beneath and to support both sets of tracks 12 and 14, it would be advantageous and desirable to use these ties, since both sets of tracks 12 and 14 and the elastomeric pads then would be supported by the same ties and the entire crossing structure would be effectively tied together and form a unitary structure. However, most ties are of a standard length, generally 8'6". Otherwise, ties generally are available in increments of additional one foot lengths, up to maximums of approximately 16 feet. Therefore, longer ties of the length described above are normally not readily available.

Accordingly, in order to effectively provide a unitary crossing structure, a standard 8'6" tie and a longer 16' foot tie are used in combination, with the positioning of the long and short ties being alternated from right to left, as illustrated in FIGS. 3 and 5. More particularly, as can be best seen in FIG. 3, a short tie **19*a* is disposed beneath the set of tracks 14. A longer tie 19*b* abuts against the end of the short tie 14*a* and extends beneath and supports the set of tracks 12. The next or adjacent set of ties are alternated, with the longer tie 19*b* extended beneath the set of tracks 14 and the shorter tie 19*a* extending beneath the set of tracks 12. The sets of ties 19*a* and 19*b*** are alternated in this fashion across the entire width of the crossing structure, with the net result being a crossing structure which is essentially unitary and tied together.

Accordingly, from the above description, it can be seen that an improved railroad crossing structure is provided which is comprised of elastomeric pads which are of the construction disclosed in U.S. Pat. No. 4,093,120 and are secured in place as therein disclosed, without the use of spikes. The pads not only are disposed between and along the side or field edges of the rails, but also are disposed across the devil strip between the adjacent sets of tracks. The entire railroad crossing structure therefore has an elastomeric surface.

Other types of elastomeric pads as disclosed, for example, in U.S. Pat. Nos. 4,117,977; 3,843,051; 3,866,830; 2,828,079; and 2,828,080, can be utilized when modified to function as described above. However, when pads of these types are used, spikes must be utilized to secure the pads in place; hence all of the advantages associated with the use of the pads of the type disclosed in U.S. Pat. No. 4,093,120 are not available.

It will thus be seen that the objects set forth above, among those made apparent from the preceding description, are efficiently attained and certain changes may be made in the above construction. Accordingly, it is intended that all matter contained in the above description, or shown in the accompanying drawings, shall be interpreted as illustrative and not in a limiting sense.

Now that the invention has been described, what is claimed as new and desired to be secured by Letters Patent is:

1. A railroad crossing structure for use with a highway railroad crossing having at least two sets of tracks with a devil strip between them, each of said sets of tracks having a pair of spaced, substantially parallel rails, a plurality of elongated ties subtending and supporting said rails and being disposed transversely thereof, each of said plurality of elongated ties being comprised of a short tie extending beneath said pair of rails of one set of tracks and a longer tie which spans said devil strip and extends beneath said pair of rails of the other one of said set of tracks, the positioning of said short tie and said longer tie of each adjacent elongated tie being alternated, whereby a unitary crossing structure is provided, means for securing said rails to said ties, and a plurality of elastomeric pads secured atop and supported by said ties, said plurality of elastomeric pads being proportioned to span said devil strip and to abut against the one rail of each track adjacent said devil strip, whereby the devil strip between adjacent sets of tracks is provided with an elastomeric surface.

2. The railroad crossing structure of claim 1, further comprising shim means atop said ties and disposed between said rails, whereby a flat support surface extending substantially from rail-to-rail across said devil strip is provided to support said elastomeric pads.

3. The railroad crossing structure of claim 2, wherein each of said elastomeric pads has a flexible plate of a generally concave cross-section imbedded within it, securement means affixed to the opposite sides of said flexible plate along the longitudinal edges thereof and tie down means extending longitudinally through said elastomeric pad and secured respectively to the opposite side edges of said flexible plate by means of said securement means; and anchor means for securing said elastomeric pads atop said bridge members, said tie down means being secured at the opposite ends thereof to said anchor means.

4. The railroad crossing structure of claim 3, wherein the adjoining edges of said elastomeric pads are formed with complimentary interlocking means, whereby the edges of said pads abutted and secured together are sealed so as to be substantially moisture-proof.

5. The railroad crossing structure of claim 3, further comprising a plurality of said elastomeric pads in end-to-end relationship, said tie down means extending longitudinally through said pads in end-to-end relationship to secure said pads in place.

6. The railroad crossing structure of claim 5, wherein the abutting edges of said pads all are correspondingly formed with complimentary interlocking means, whereby the edges of said pads abutted and secured together are sealed so as to be substantially moisture-proof.

7. The railroad crossing structure of claim 3, wherein said tie down means comprises a steel cable.

8. The railroad crossing structure of claim 3, wherein said tie down means comprises a steel rod.

* * * * *